US009682298B1

(12) United States Patent
Kingston et al.

(10) Patent No.: US 9,682,298 B1
(45) Date of Patent: Jun. 20, 2017

(54) GOLF CLUB HEAD WITH ADJUSTABLE WEIGHTING

(71) Applicant: CALLAWAY GOLF COMPANY, Carlsbad, CA (US)

(72) Inventors: Keith L. Kingston, Carlsbad, CA (US); Matthew Myers, Carlsbad, CA (US); Wee Joung Kim, Vista, CA (US)

(73) Assignee: Callaway Golf Company, Carlsbad, CA (US)

( * ) Notice: Subject to any disclaimer, the term of this patent is extended or adjusted under 35 U.S.C. 154(b) by 44 days.

(21) Appl. No.: 15/012,493

(22) Filed: Feb. 1, 2016

Related U.S. Application Data

(63) Continuation-in-part of application No. 14/933,973, filed on Nov. 5, 2015, now Pat. No. 9,623,294, which is a continuation-in-part of application No. 14/163,946, filed on Jan. 24, 2014, now Pat. No. 9,211,453, and a continuation-in-part of application No. 14/174,068, filed on Feb. 6, 2014, now Pat. No. 9,289,660.

(51) Int. Cl.
*A63B 53/06* (2015.01)
*A63B 53/04* (2015.01)

(52) U.S. Cl.
CPC ..... *A63B 53/06* (2013.01); *A63B 53/0466* (2013.01); *A63B 2053/0433* (2013.01); *A63B 2053/0491* (2013.01)

(58) Field of Classification Search
USPC ..... 473/324–350
See application file for complete search history.

(56) References Cited

U.S. PATENT DOCUMENTS 5,683,309 A * 11/1997 Reimers ..... A63B 53/04 473/337
5,688,189 A * 11/1997 Bland ..... A63B 53/065 473/314
6,015,354 A * 1/2000 Ahn ..... A63B 53/04 473/256

(Continued)

FOREIGN PATENT DOCUMENTS

JP 01043278 A * 2/1989
JP 2005296582 A * 10/2005

(Continued)

*Primary Examiner* — Alvin Hunter
(74) *Attorney, Agent, or Firm* — Rebecca Hanovice; Michael Catania; Sonia Lari

(57) ABSTRACT

A golf club head comprising a means for adjusting the location of the center of gravity is disclosed herein. In particular, the golf club head of the present invention comprises two channels, each having at least one shoulder portion, a floor, and a rail extending upwards from the floor. The channels intersect at a junction, and a slidable weight comprising a top portion, a mechanical fastener, and a clamping structure is disposed within at least one of the channels. When the mechanical fastener is tightened, the top portion presses against the at least one shoulder portion and pulls the clamping structure upward so that the clamping structure grips the rail. The rails are spaced from one another at the junction, and the clamping structure allows the slidable weight to be moved into either of the channels without being indexed.

20 Claims, 5 Drawing Sheets

(56) References Cited

U.S. PATENT DOCUMENTS 6,277,032 B1 * 8/2001 Smith ..... A63B 53/04 473/336
6,890,267 B2 * 5/2005 Mahaffey ..... A63B 53/0466 473/256
7,121,956 B2 * 10/2006 Lo ..... A63B 53/04 473/335
7,128,662 B2 * 10/2006 Kumamoto ..... A63B 53/0466 473/345
7,147,573 B2 12/2006 DiMarco
7,166,041 B2 * 1/2007 Evans ..... A63B 53/0466 473/334
7,452,286 B2 * 11/2008 Lin ..... A63B 53/0466 473/334
7,611,424 B2 * 11/2009 Nagai ..... A63B 53/0466 473/334
7,704,163 B2 * 4/2010 Stites ..... A63B 53/047 473/334
7,775,905 B2 * 8/2010 Beach ..... A63B 53/0466 473/256
7,806,782 B2 * 10/2010 Stites ..... A63B 53/0466 473/334
7,824,280 B2 * 11/2010 Yokota ..... A63B 53/0466 473/334
8,016,694 B2 * 9/2011 Llewellyn ..... A63B 53/0466 473/334
8,192,303 B2 * 6/2012 Ban ..... A63B 53/0466 473/335
8,202,175 B2 * 6/2012 Ban ..... A63B 53/0466 473/334
8,262,495 B2 * 9/2012 Stites ..... A63B 53/047 473/226
8,696,491 B1 * 4/2014 Myers ..... A63B 53/06 473/334
8,790,195 B1 * 7/2014 Myers ..... A63B 53/0466 473/335
8,821,307 B2 * 9/2014 Park ..... A63B 53/04 473/244
8,894,506 B1 * 11/2014 Myers ..... A63B 53/0466 473/334
8,968,116 B1 * 3/2015 Myers ..... A63B 53/0466 473/334
9,101,811 B1 * 8/2015 Goudarzi ..... A63B 53/0466
9,211,453 B1 * 12/2015 Foster ..... A63B 53/06
9,289,660 B1 * 3/2016 Myers ..... A63B 53/06
9,387,376 B1 * 7/2016 Hall ..... A63B 53/06
2006/0122004 A1 * 6/2006 Chen ..... A63B 53/0466 473/335
2006/0178228 A1 * 8/2006 DiMarco ..... A63B 53/0466 473/334
2006/0240908 A1 * 10/2006 Adams ..... A63B 53/0466 473/334
2008/0020861 A1 * 1/2008 Adams ..... A63B 53/04 473/334
2008/0261715 A1 * 10/2008 Carter ..... A63B 53/0466 473/291
2010/0075773 A1 * 3/2010 Casati, Jr. ..... A63B 49/02 473/334
2010/0292027 A1 11/2010 Beach et al.
2011/0053705 A1 * 3/2011 Stites ..... A63B 53/0466 473/334
2015/0321055 A1 * 11/2015 Golden ..... A63B 53/0466 473/338

FOREIGN PATENT DOCUMENTS

JP 2005323978 A * 11/2005
JP 2006-320493 11/2006
JP 2006320493 A * 11/2006
JP 2008086337 A * 4/2008
JP 2010252964 A * 11/2010
JP 2011010722 A * 1/2011
JP 2014111170 A * 6/2014 ..... A63B 53/0466
WO WO 2007044220 A1 * 4/2007 ..... A63B 53/06

* cited by examiner

GOLF CLUB HEAD WITH ADJUSTABLE WEIGHTING

CROSS REFERENCES TO RELATED APPLICATIONS

The present application is a continuation-in-part of U.S. patent application Ser. No. 14/933,973, filed on Nov. 5, 2015, which is a continuation-in-part of U.S. patent application Ser. No. 14/163,946, filed on Jan. 24, 2014, and issued on Dec. 15, 2015, as U.S. Pat. No. 9,211,453, and is also a continuation-in-part of U.S. patent application Ser. No. 14/174,068, filed on Feb. 6, 2014, the disclosure of each of which is hereby incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to a golf club head. More specifically, the present invention relates to a slidable weight for a golf club head that can be adjusted along one or more channels in the golf club head.

Description of the Related Art

The ability to adjust center of gravity location and weight in a golf club head is useful for controlling performance of the golf club. The prior art includes several different solutions for adjustable weighting, but these solutions do not optimize weight adjustment, especially along tracks or channels that follow the curvature of the golf club head or intersect with other channels. For example, several golf club manufacturers employ slidable weights that clamp a pair of rails in a channel when the weights are fixed in place, but these designs are more complex and costly than they need to be, and the presence of multiple rails increases the overall weight of the golf club head and reduces the amount of discretionary mass available to the manufacturer during the design process. Therefore, there is a need for a weighting mechanism that allows for simple and flexible center of gravity (CG) and moment of inertia (MOI) adjustability along channels that intersect with one another and follow a golf club head's curvature.

BRIEF SUMMARY OF THE INVENTION

The present invention allows consumers to easily move and fix a weight at any location within intersecting channels disposed in the golf club head in such a way to maximize aesthetic appearances while preserving the function of the movable weight. The objective of this invention is to provide an adjustable weighting feature for lateral center of gravity control which is placed to maximize effectiveness and may be entirely concealed from view at address. Additional goals include minimizing the fixed component of the structure dedicated to the weighting system and also minimizing any potential effect on impact sound.

The slidable weight of the present invention fits within one or more contoured or rounded tracks and can be clamped to any location along the tracks. The slidable weight is added to a track at a single location, and, when engaged with a track, the slidable weight has multiple points of contact at each location on the track despite the changing contour and track geometry.

One aspect of the present invention is a golf club head comprising a body comprising a first channel and a weight assembly comprising at least one mechanical fastener comprising a head portion and a threaded extension portion, a top portion comprising a first upper surface, a first lower surface, and a first through-bore sized to receive the head portion of the at least one mechanical fastener, and a base portion comprising a second upper surface, a second lower surface, a second, threaded through-bore extending from the second upper surface to the second lower surface and sized to receive the threaded extension portion of the at least one mechanical fastener, and a clamping portion extending from the lower surface, wherein the first channel comprises a first floor, at least one first shoulder portion, and a first rail, wherein the first rail extends from the first floor in a direction normal to the first floor, wherein the clamping portion is sized to receive at least an upper portion of the first rail, and wherein, when the clamping portion is engaged with the first rail, tightening the mechanical fastener pulls the top portion towards the base portion and causes the first lower surface of the top portion to press against the at least one first shoulder portion and the clamping portion to reversibly grip the upper portion of the first rail. In some embodiments, the first lower surface may comprise at least one convex protrusion, and preferably a plurality of convex protrusions, and each convex protrusion may be spaced from adjacent convex protrusions to form a wave- or tooth-like configuration.

In other embodiments, the first rail may comprise a chamfered end region. In some embodiments, the clamping portion may comprise a plurality of tapered projections, each pair of adjacent tapered projections may form a slot between them, and each slot may be sized to receive an upper portion of the first rail. In a further embodiment, each of the plurality of tapered projections may have a first plurality of surface radii, the first rail may have a second plurality of surface radii, and the first plurality of surface radii may be smaller than the second plurality of surface radii. In another further embodiment, the plurality of tapered projections may comprise four tapered projections, which may be evenly spaced around the second through-bore.

In a further embodiment, the body may comprise a second channel comprising at least one second shoulder portion, a second floor, and a second rail extending from the second floor in a direction normal to the second floor, wherein the clamping portion is sized to receive at least an upper portion of the second rail, and wherein, when the clamping portion is engaged with the second rail, tightening the mechanical fastener pulls the top portion towards the base portion and causes the first lower surface of the top portion to press against the at least one second shoulder portion and the clamping portion to reversibly grip the upper portion of the second rail. In a further embodiment, the second channel may extend in a direction approximately perpendicular to at least a portion of the first channel. In another embodiment, the second channel may intersect the first channel to form a junction, the first rail may comprise a first chamfered end region, the second rail may comprise a second chamfered end region, and each of the first and second chamfered end regions may be disposed within the junction. In a further embodiment, the clamping portion may have a first width, an open space may be disposed within the junction between the first chamfered end region and the second chamfered end region, and the open space may have a second width that is greater than the first width.

In a further embodiment, the golf club head may further comprising a plug sized to fit within the open space and prevent the first weight from disengaging from either of the first and second rails. In another embodiment, the first rail may comprise a first rail segment and a second rail segment, the first rail segment may be spaced from the second rail segment to form an open space, the clamping portion may have a first width, and the open space may have a second width that is greater than the first width. In yet another embodiment, the first rail may have a cross-sectional shape selected from the group consisting of T-shaped, V-shaped, and Y-shaped.

Yet another aspect of the present invention is a golf club head comprising a face component, a sole comprising a heel side, a toe side, a rear side, a first channel extending from the heel side to the toe side via the rear side, and a second channel extending from a location proximate the face component to the rear side and intersecting the first channel at the rear side to form a junction, a crown, and a weight assembly comprising at least one mechanical fastener comprising a head portion and a threaded extension portion, a top portion comprising a first through-bore sized to receive the head portion of the at least one mechanical fastener, and a base portion comprising a clamping portion and a second, threaded through-bore sized to receive the threaded extension portion of the at least one mechanical fastener, wherein the clamping portion comprises a plurality of projections spaced from one another to form at least one slot, wherein the first channel comprises first and second shoulders, a first floor, a first rail extending normal to the first floor, and a second rail extending normal to the first floor, wherein the second channel comprises third and fourth shoulders, a second floor, and a third rail extending normal to the second floor, wherein the first and second rails each have a first cross-section, wherein the third rail has a second cross-section, wherein the first cross-section has approximately the same dimensions as the second cross-section, wherein the first, second, and third rails are spaced from one another to form an open space at the junction, wherein each of the at least one slot is sized to receive at least an upper portion of the first, second, and third rails, and wherein, when the clamping portion is engaged with one of the first, second, and third rails, tightening the mechanical fastener reversibly fixes the weight assembly within one of the first and second channels.

In some embodiments, each of the first, second, and third rails may have a chamfered end region located proximate the junction. In other embodiments, each of the first and second cross-sections may have a shape selected from the group consisting of T-shaped, V-shaped, and Y-shaped. In yet other embodiments, the golf club head may be selected from the group consisting of a driver head, a fairway wood head, and a hybrid head. In some embodiments, the top portion may be composed of a first material, the base portion may be composed of a second material, and the first material may have a different density than the second material. In a further embodiment, the first material may have a higher density than the second material.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
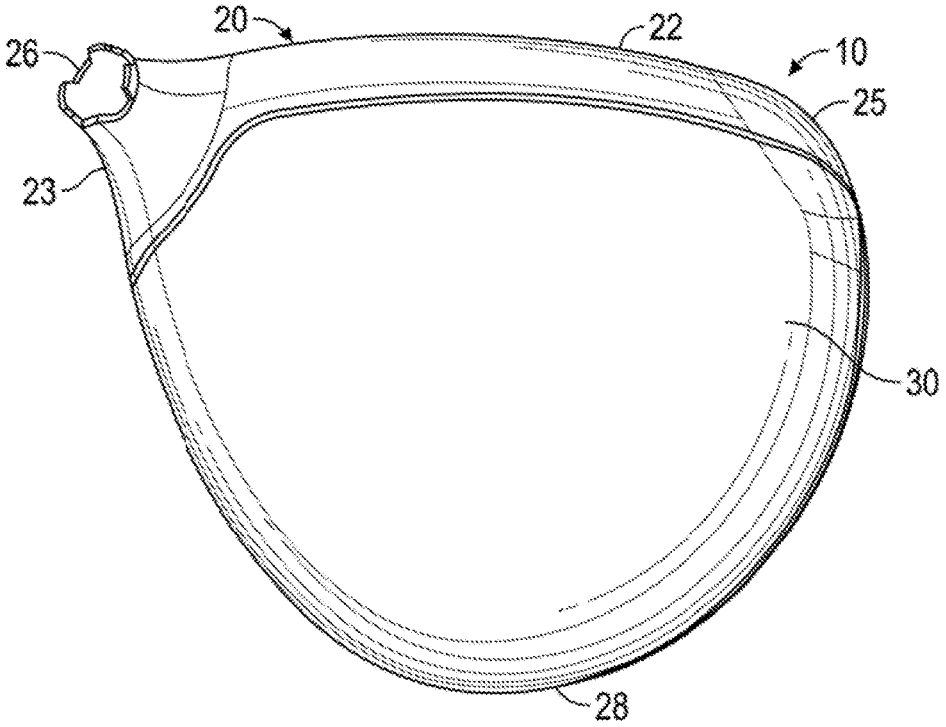
FIG. 1 is a top plan view of the golf club head of the present invention.

The design approaches described herein are based on a construction used in a driver head characterized by a composite crown adhesively bonded to a cast titanium body. This particular construction approach permits the crown configuration to be adapted to the inventive weighting scheme with minimal impact on weight and function. However, the weighting embodiments disclosed herein can be used with other constructions, including all titanium, all composite, and a composite body with metal face cup. The embodiments may also work in conjunction with at least one adjustable weight port on the sole, crown, and/or other part of the driver head. Shifting weight along the channel described herein gives a user control of the golf club head's center of gravity location and other mass properties.

A preferred embodiment of the present invention is shown in FIGS. 1-10. The golf club head 10 comprises a body 20 composed of a metal material and a crown 30 composed of a composite material covering an upper opening (not shown) in the body 20. The body 20 includes a face 22, a heel side 23, a toe side 25, a hosel 26, a rear side 28, and a sole 40, and preferably is integrally cast from a titanium or steel alloy, though it may be made from a carbon composite material, including one or more of the materials disclosed in U.S. Pat. No. 9,033,822, the disclosure of which is incorporated by reference in its entirety herein.

Figure 2:
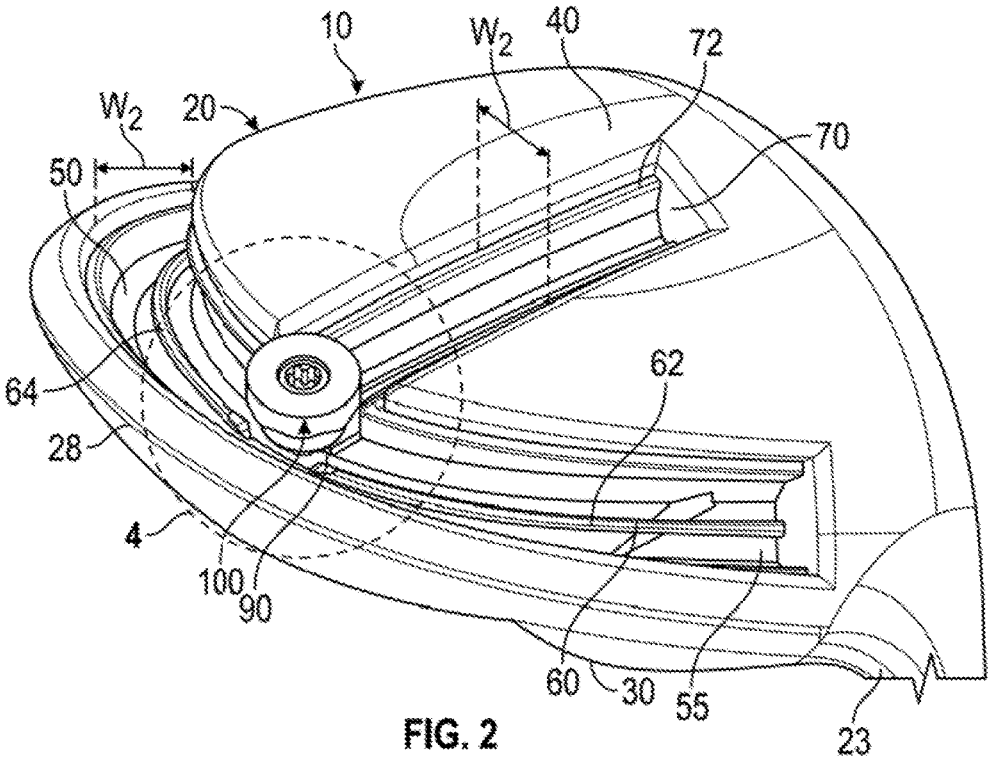
FIG. 2 is a bottom perspective view of the embodiment shown in FIG. 1.
Figure 3:
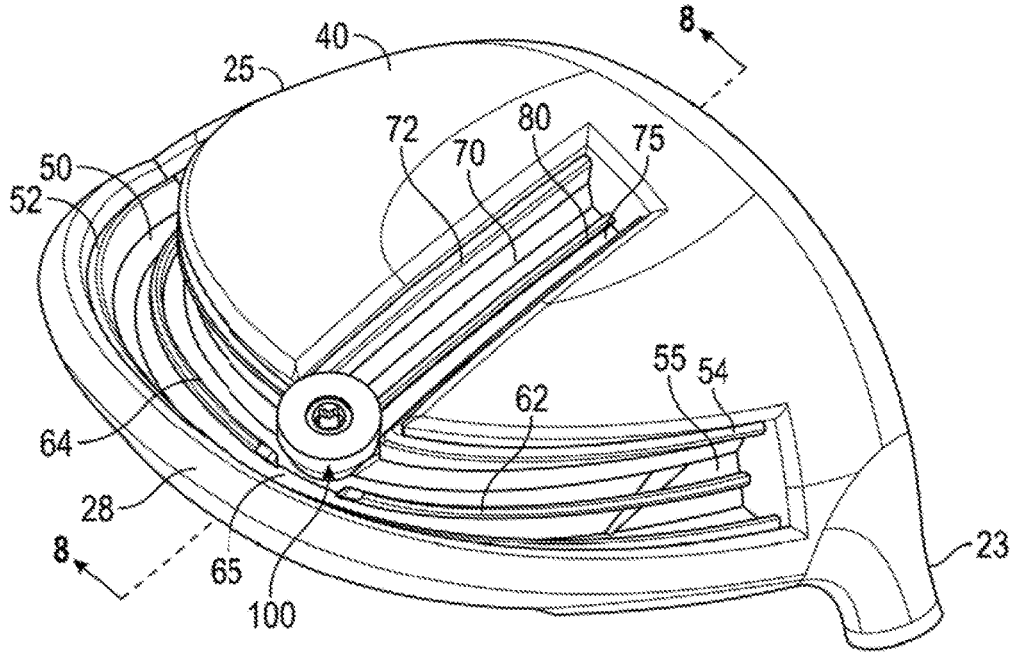
FIG. 3 is another bottom perspective view of the embodiment shown in FIG. 1.

As shown in FIGS. 2 and 3, the sole 40 includes a first elongated channel 50 that extends from the heel side 23 to the toe side 25 via the rear side 28 and receives a slidable weight assembly 100 on a rail 60 extending upwards from, and approximately normal to, a floor 55 of the elongated channel 50. The rail 60 has two segments 62, 64 separated by an open space 65 where the weight assembly 100 can be inserted into the elongated channel 50 and onto one of the rail 60 segments 62, 64. The rail 60 preferably is integrally cast, molded, forged, or formed with the body 20, but in an alternative embodiment may be separately created and assembled as disclosed in U.S. patent application Ser. No. 14/174,068, the disclosure of which is hereby incorporated by reference in its entirety herein. The elongated channel 50 also includes a pair of shoulders 52, 54, extending from the side walls 51, 53 of the channel 50, and which preferably are located closer to the sole 40 surface than to the floor 55 of the channel 50.

The sole 40 includes a second elongated channel 70, which is linear, extends approximately normal to the face 22 in a front-to-back direction, and intersects the first elongated channel 50 at a junction 90 located at an approximate midpoint 56 of the first elongated channel 50. The second channel 70 also includes a pair of shoulders 72, 74, a floor 75, and a rail 80 extending upwards from, and approximately normal to, the floor 75. As shown in the Figures, the rail 80 in the second channel 70 is spaced from the rail segments 62 in the first channel 50 to maintain the open space 65.

Figure 5:
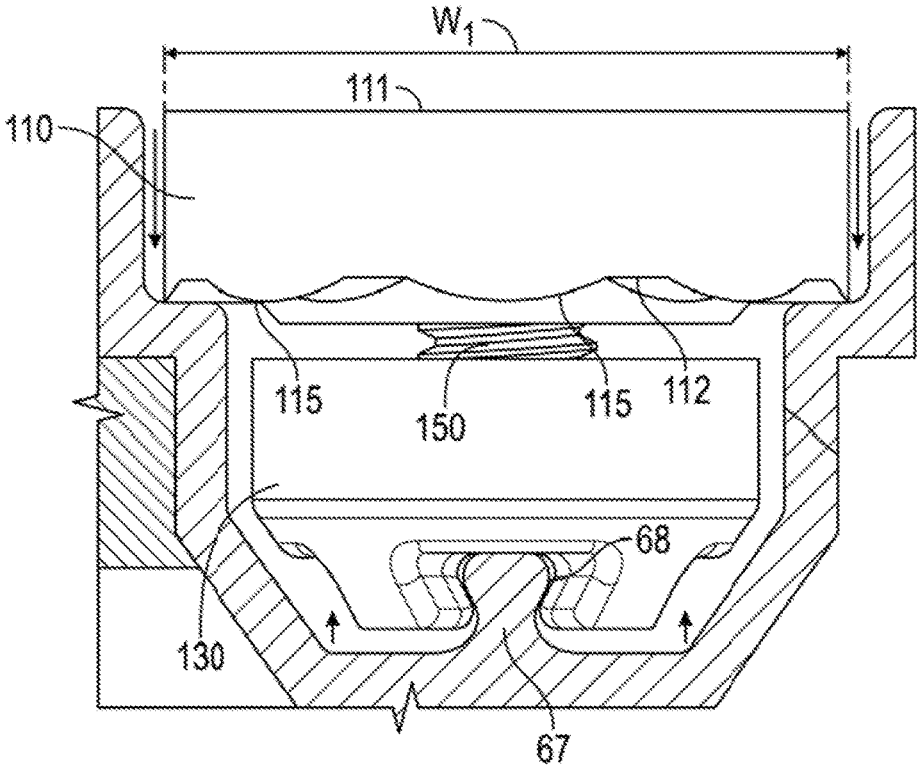
FIG. 5 is a cross-sectional view of the slidable weight shown in FIG. 4 along lines 5-5.

As shown in FIG. 5, each of the rails 60, 80 has a cross-sectional shape that tapers in thickness from a narrow region 67 to a thicker region 68. Each rail's 60, 80 cross-sectional dimensions (e.g., thickness, height, radii, etc.) are preferably the same, taking into account manufacturing tolerances. As shown in the Figures, the rails 60, 80 in the preferred embodiment have approximately Y-shaped cross-sections, but in alternative embodiments the rails 60, 80 may have Y- or T-shaped cross-sections.

The weight assembly 100 of the present invention, which may have any shape but preferably is approximately circular as shown in the Figures, includes a top portion 110, a base portion 130, and a mechanical fastener 150 connecting the top portion 110 to the base portion 130. When tightened, the mechanical fastener 150, which has a head portion 152 and a threaded extension portion 154 extending from the head portion 152, pulls the base portion 130 towards the top portion 110 to create a clamping force. The circular shape of the weight assembly 100 allows it to move smoothly within straight, rounded, and contoured channels 50, 70 without requiring a specific orientation therein.

Figure 4:
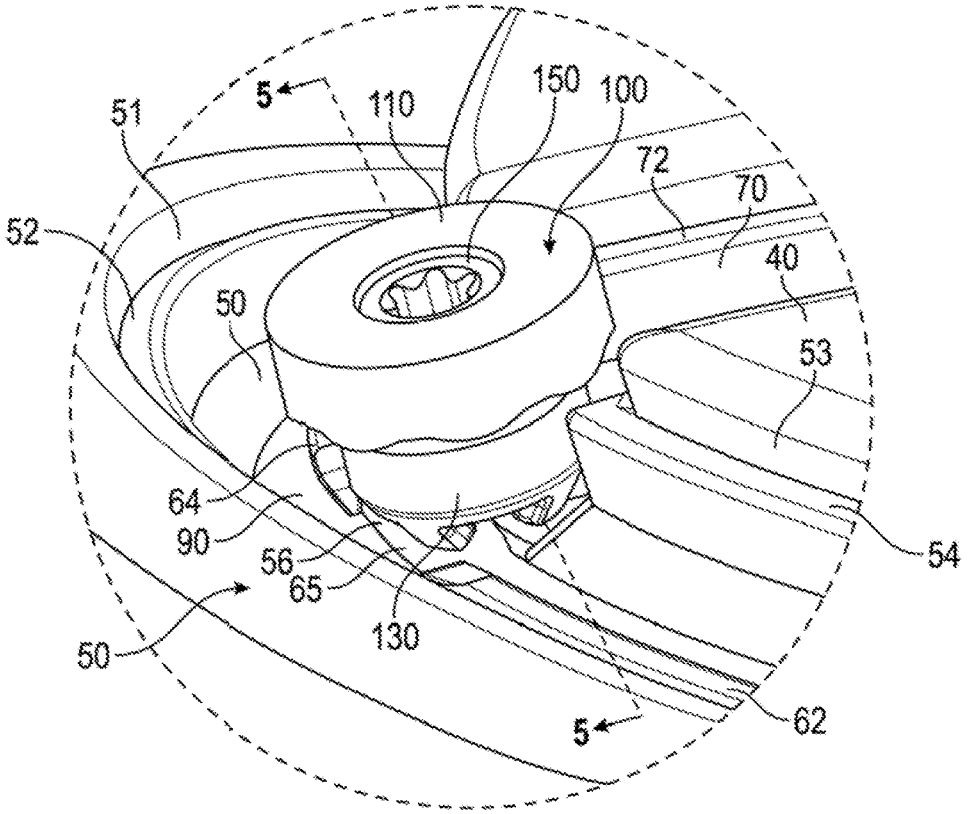
FIG. 4 is an enlarged view of the circled portion of the embodiment shown in FIG. 2.
Figure 6:
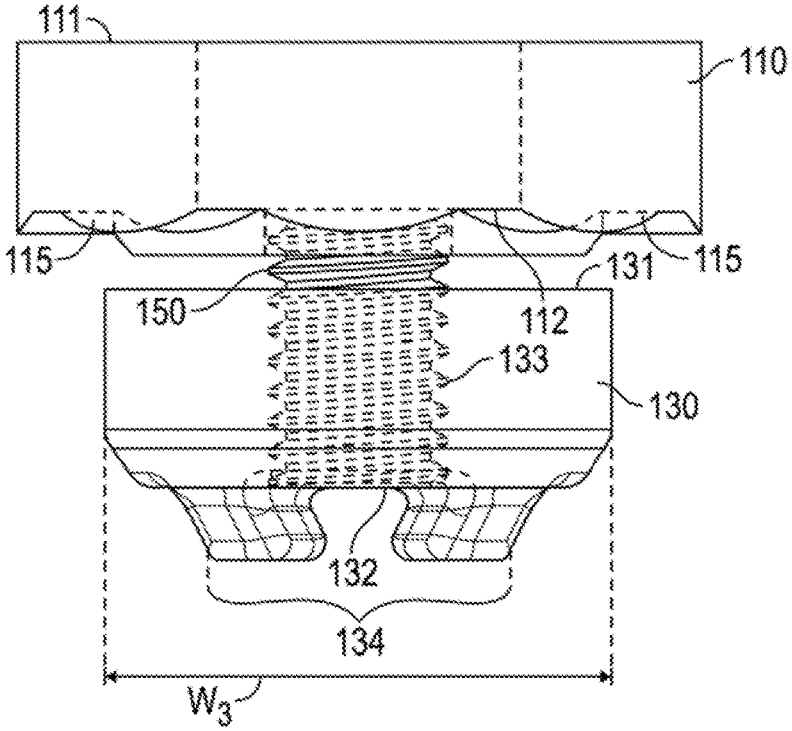
FIG. 6 is a side elevational view of the slidable weight shown in FIGS. 2-4.
Figure 7:
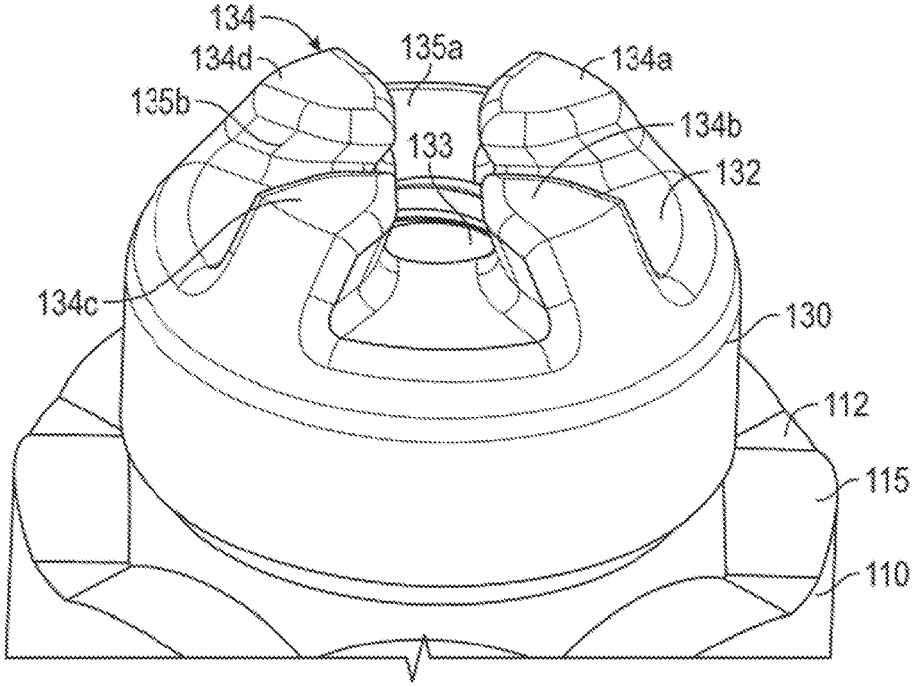
FIG. 7 is a bottom elevational view of the slidable weight shown in FIG. 6.
Figure 8:
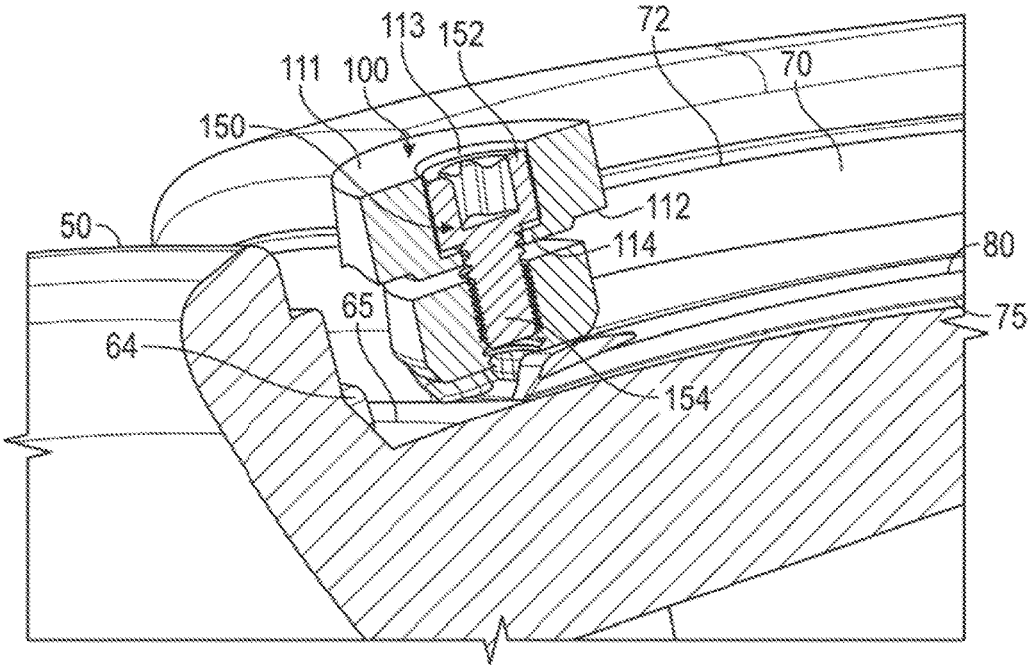
FIG. 8 is a cross-sectional view of the embodiment shown in FIG. 3 along lines 8-8.

As shown in FIGS. 4-6, the top portion 110 comprises an upper surface 111, a lower surface 112, a through-bore 113 sized to receive the mechanical fastener 150, and particularly the head portion 152, an internal ledge 114 within the through-bore 113 to prevent the head portion 152 of the mechanical fastener 150 from disengaging from the top portion 110, and a plurality of convex protrusions 115 extending from the lower surface 112 around the circumference of the top portion 110. The convex protrusions 115 preferably are spaced from one another to form a wave- or tooth-like pattern. The top portion 110 has a width $W_1$ that is slightly less than the largest width $W_2$ of the channels 50, 70, and preferably is composed of a high density material such as a tungsten alloy, though it may be made of any materials known to a person skilled in the art.

The base portion 130 has a width $W_3$ that is less than W1 and includes an upper surface 131, a lower surface 132, a threaded through-bore 133 sized to receive the threaded extension portion 154 of the mechanical fastener 150, and a clamping portion 134 extending from the lower surface 132. The clamping portion 134 comprises four tapered projections 134*a*, 134*b*, 134*c*, 134*d* that are evenly spaced around the threaded through-bore 133 and that form a pair of tapering slots 135*a*, 135*b* having the same general cross-sectional shape and geometry as that of the rails 60, 80, e.g., Y-shaped, V-shaped, or T-shaped.

Figure 9:
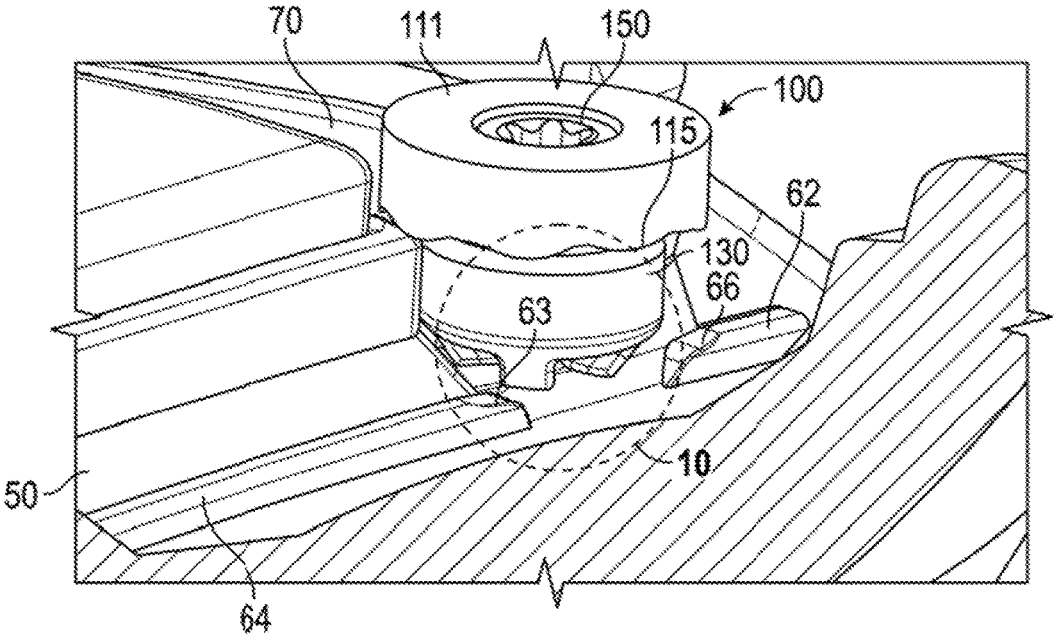
FIG. 9 is an enlarged view of the embodiment shown in FIG. 2 with the slidable weight engaged with one of the rear rails on the golf club head.
Figure 10:
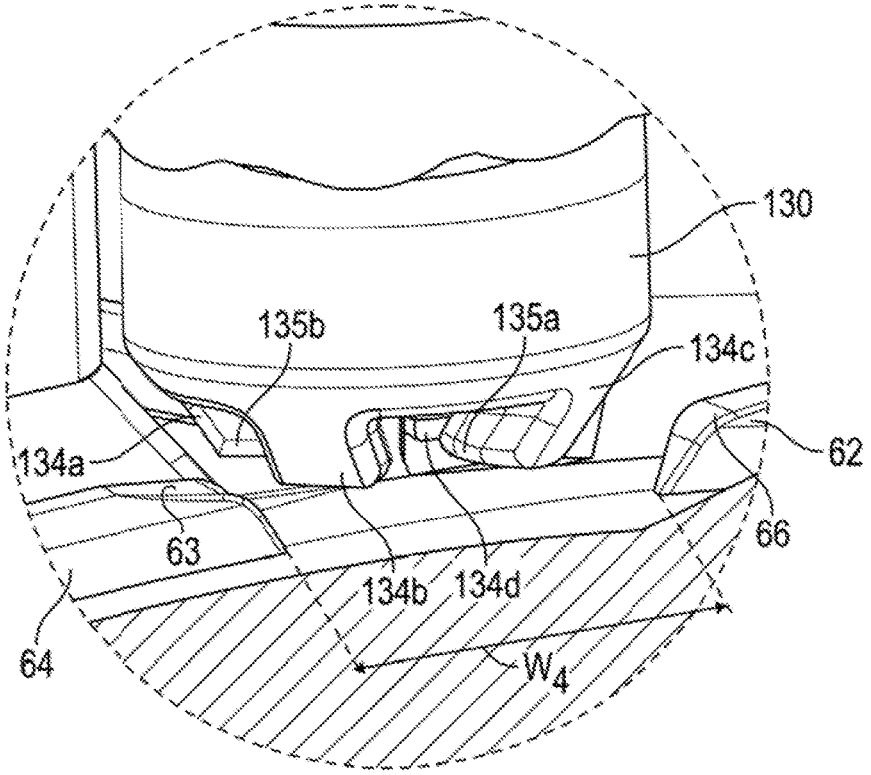
FIG. 10 is an enlarged view of the circled portion of the embodiment shown in FIG. 9.

As shown in FIGS. 9 and 10, the weight assembly 100 is attached to one of the rails 60, 80 in a channel 50, 70 by inserting it into the open space 65 and then sliding the selected rail 60, 80 into one of the tapering slots 135*a*, 135*b* in the base portion 130 of the weight assembly 100. As illustrated in FIG. 10, the open space 65 between the rail segments 62, 64 and the second rail 80 has a width $W_4$ that is slightly larger than $W_3$ so that the weight assembly 100, and particularly the base portion 130, has enough room to be placed within an elongated channel 50, 70 in such a way that it can be slid onto a rail 60, 80. It is important that the end portion 63, 66, 82 of each rail 60, 80 is chamfered as shown in FIG. 10 so as to guide the base portion 130 onto the rails 60, 80 via the tapering slots 135*a*, 135*b*. Without the chamfering, it is more difficult to engage the weight assembly 100 with the rails 60, 80.

Once the weight assembly 100 of the present invention is engaged with a rail 60, 80 and the mechanical fastener 150 has not yet been tightened, the weight assembly 100 can move freely within the selected channel 50, 70 and be clamped at any position on the chosen rail 60, 80 except for the open space 65 between the rail 60 segments 62, 64 and second rail 80. As shown in FIG. 5, when the mechanical fastener 150 is tightened using a tool sized to engage with the head portion 152, the base portion 130 is pulled upwards away from the floor 55, 75 of the selected channel 50, 70, while the top portion 110 is pressed against the shoulders 52, 54, 72, 74 of the selected channel 50, 70, thus causing the clamping portion 134 to pull up on the underside of the selected rail 60, 80. This creates a clamping force between lower sides of the selected rail 60, 80 and the inner surfaces of the tapered projections 134*a*, 134*b*, 134*c*, 134*d*. Furthermore, the rounded nature of the convex protrusions 115 serves to reduce the surface area of the top portion 110 making contact with the shoulders 52, 54, 72, 74 and to increase the clamping force provided by the weight assembly 100 at any given location on the channels 50, 70. In this way, the weight assembly 100 is reversibly fixed to the selected rail 60, 80 within the selected channel 50, 70 and will not be dislodged when the golf club head 10 is in use. The curvature of the tapered projections' 134*a*, 134*b*, 134*c*, 134*d* inner surfaces allows the weight assembly 100 to move freely within the channels 50, 70, as they have smaller radii than that of the rail's 60, 80 radii.

If a golfer wishes to move the weight assembly 100 from one channel 50, 70 to another, she need only loosen the mechanical fastener 150 so that the top portion 110 and base portion 130 move away from another and release the clamping force on the rail 60, 80 and shoulders 52, 54, 72, 74, slide the weight assembly 100 into the open space 65, and then, without removing or indexing the weight assembly 100, slide it onto a different rail 60, 80 and re-tighten the mechanical fastener 150. The orientation of the tapering slots 135*a*, 135*b* permit this easy transition from one channel 50, 70 into another, perpendicular or intersecting channel 50, 70.

The open space 65 at the junction 90 may be filled with a plug (not shown) to further ensure that none of the weight assemblies 100 becomes disengaged from the elongated channels 50, 70. The plug may have clamping features that snap onto one or any of the rails 60, 80, and/or it may include a threaded bore that lines up with a threaded bore in the open space 65 to receive a bolt to secure it to the golf club head 10. The plug may also have any of the features of the stopper disclosed in U.S. patent application Ser. No. 14/174,068 or the weight screw or plug disclosed in U.S. patent application Ser. No. 14/163,946.

In any of the embodiments disclosed herein, the crown 30 may be affixed to the body 20 with an adhesive material. The crown 30 is formed from a light-weight material, preferably a non-metal material such as a composite, which may be selected from any of the composite materials disclosed in U.S. Pat. Nos. 8,460,123 and 9,033,822, the disclosure of each of which is hereby incorporated by reference in its entirety herein.

The rail 60 and plug may be formed as disclosed in U.S. patent application Ser. No. 14/174,068, the disclosure of which is hereby incorporated by reference in its entirety herein. Similarly, the elongated channels 50, 70 disclosed herein may have any of the configurations disclosed in U.S. Pat. No. 8,696,491, the disclosure of which is hereby incorporated by reference in its entirety herein, and the elongated channels 50, 70 disclosed herein may be disposed anywhere on the golf club head 10, including the sole 40, crown 30, face 22, and ribbon portions, if applicable. Though the embodiment disclosed herein is shown in a driver, the inventive adjustable weighting configuration may also be used with other type of golf clubs, including fairway woods, irons, wedges, hybrids, and putters.

In other embodiments, the golf club head 10 may have a multi-material composition such as any of those disclosed in U.S. Pat. Nos. 6,244,976, 6,332,847, 6,386,990, 6,406,378, 6,440,008, 6,471,604, 6,491,592, 6,527,650, 6,565,452, 6,575,845, 6,478,692, 6,582,323, 6,508,978, 6,592,466, 6,602,149, 6,607,452, 6,612,398, 6,663,504, 6,669,578, 6,739,982, 6,758,763, 6,860,824, 6,994,637, 7,025,692, 7,070,517, 7,112,148, 7,118,493, 7,121,957, 7,125,344, 7,128,661, 7,163,470, 7,226,366, 7,252,600, 7,258,631, 7,314,418, 7,320,646, 7,387,577, 7,396,296, 7,402,112, 7,407,448, 7,413,520, 7,431,667, 7,438,647, 7,455,598, 7,476,161, 7,491,134, 7,497,787, 7,549,935, 7,578,751, 7,717,807, 7,749,096, and 7,749,097, the disclosure of each of which is hereby incorporated in its entirety herein.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim:

1. A golf club head comprising:

a body comprising a first channel; and a weight assembly comprising:

at least one mechanical fastener comprising a head portion and a threaded extension portion;

a top portion comprising a first upper surface, a first lower surface, and a first through-bore sized to receive the head portion of the at least one mechanical fastener; and a base portion comprising a second upper surface, a second lower surface, a second, threaded through-bore extending from the second upper surface to the second lower surface and sized to receive the threaded extension portion of the at least one mechanical fastener, and a clamping portion extending from the lower surface, wherein the first channel comprises a first floor, at least one first shoulder portion, and a first rail, wherein the first rail extends from the first floor in a direction normal to the first floor, wherein the clamping portion is sized to receive at least an upper portion of the first rail, and wherein, when the clamping portion is engaged with the first rail, tightening the mechanical fastener pulls the top portion towards the base portion and causes the first lower surface of the top portion to press against the at least one first shoulder portion and the clamping portion to reversibly grip the upper portion of the first rail.

2. The golf club head of claim 1, wherein the first lower surface comprises at least one convex protrusion.

3. The golf club head of claim 2, wherein the first lower surface comprises a plurality of convex protrusions, and wherein each convex protrusion is spaced from adjacent convex protrusions.

4. The golf club head of claim 1, wherein the first rail comprises a chamfered end region.

5. The golf club head of claim 1, wherein the clamping portion comprises a plurality of tapered projections, wherein each pair of adjacent tapered projections forms a slot between them, and wherein each slot is sized to receive an upper portion of the first rail.

6. The golf club head of claim 5, wherein each of the plurality of tapered projections has a first plurality of surface radii, wherein the first rail has a second plurality of surface radii, and wherein the first plurality of surface radii are smaller than the second plurality of surface radii.

7. The golf club head of claim 5, wherein the plurality of tapered projections comprises four tapered projections, and wherein the four tapered projections are evenly spaced around the second through-bore.

8. The golf club head of claim 1, wherein the body further comprises a second channel comprising:

at least one second shoulder portion;

a second floor; and a second rail extending from the second floor in a direction normal to the second floor, wherein the clamping portion is sized to receive at least an upper portion of the second rail, and wherein, when the clamping portion is engaged with the second rail, tightening the mechanical fastener pulls the top portion towards the base portion and causes the first lower surface of the top portion to press against the at least one second shoulder portion and the clamping portion to reversibly grip the upper portion of the second rail.

9. The golf club head of claim 8, wherein the second channel extends in a direction approximately perpendicular to at least a portion of the first channel.

10. The golf club head of claim 8, wherein the second channel intersects the first channel to form a junction, wherein the first rail comprises a first chamfered end region, wherein the second rail comprises a second chamfered end region, and wherein each of the first and second chamfered end regions is disposed within the junction.

11. The golf club head of claim 10, wherein the clamping portion has a first width, wherein an open space is disposed within the junction between the first chamfered end region and the second chamfered end region, and wherein the open space has a second width that is greater than the first width.

12. The golf club head of claim 11, further comprising a plug, wherein the plug is sized to fit within the open space and prevent the first weight from disengaging from either of the first and second rails.

13. The golf club head of claim 1, wherein the first rail comprises a first rail segment and a second rail segment, wherein the first rail segment is spaced from the second rail segment to form an open space, wherein the clamping portion has a first width, and wherein the open space has a second width that is greater than the first width.

14. The golf club head of claim 1, wherein the first rail has a cross-sectional shape selected from the group consisting of T-shaped, V-shaped, and Y-shaped.

15. A golf club head comprising:

a face component;

a sole comprising a heel side, a toe side, a rear side, a first channel extending from the heel side to the toe side via the rear side, and a second channel extending from a location proximate the face component to the rear side and intersecting the first channel at the rear side to form a junction;

a crown; and a weight assembly comprising:

at least one mechanical fastener comprising a head portion and a threaded extension portion;

a top portion comprising a first through-bore sized to receive the head portion of the at least one mechanical fastener; and a base portion comprising a clamping portion and a second, threaded through-bore sized to receive the threaded extension portion of the at least one mechanical fastener, wherein the clamping portion comprises a plurality of projections spaced from one another to form at least one slot, wherein the first channel comprises first and second shoulders, a first floor, a first rail extending normal to the first floor, and a second rail extending normal to the first floor, wherein the second channel comprises third and fourth shoulders, a second floor, and a third rail extending normal to the second floor, wherein the first and second rails each have a first cross-section, wherein the third rail has a second cross-section, wherein the first cross-section has approximately the same dimensions as the second cross-section, wherein the first, second, and third rails are spaced from one another to form an open space at the junction, wherein each of the at least one slot is sized to receive at least an upper portion of the first, second, and third rails, and wherein, when the clamping portion is engaged with one of the first, second, and third rails, tightening the mechanical fastener reversibly fixes the weight assembly within one of the first and second channels.

16. The golf club head of claim 15, wherein each of the first, second, and third rails has a chamfered end region located proximate the junction.

17. The golf club head of claim 15, wherein each of the first and second cross-sections has a shape selected from the group consisting of T-shaped, V-shaped, and Y-shaped.

18. The golf club head of claim 15, wherein the golf club head is selected from the group consisting of a driver head, a fairway wood head, and a hybrid head.

19. The golf club head of claim 15, wherein the top portion is composed of a first material, wherein the base portion is composed of a second material, and wherein the first material has a different density than the second material.

20. The golf club head of claim 19, wherein the first material has a higher density than the second material.

* * * * *